United States Patent [19]

Eck

[11] 4,067,222

[45] Jan. 10, 1978

[54] VEHICLE AXLE STRAIGHTENING SYSTEM

[75] Inventor: Leonard F. Eck, McPherson, Kans.

[73] Assignee: Kansas Jack, Inc., McPherson, Kans.

[21] Appl. No.: 758,845

[22] Filed: Jan. 13, 1977

Related U.S. Application Data

[63] Continuation-in-part of Ser. No. 626,450, Oct. 28, 1975, abandoned.

[51] Int. Cl.[2] ..... B21D 1/12

[52] U.S. Cl. ..... 72/389; 72/457; 72/704; 72/705

[58] Field of Search ..... 72/389, 704, 705, 457, 72/458

[56] References Cited

U.S. PATENT DOCUMENTS

| | | | |
|---|---|---|---|
| Re. 18,714 | 1/1933 | Wochner | 72/705 |
| 1,702,794 | 2/1929 | Nichols | 72/704 |
| 1,845,532 | 2/1932 | Titus | 72/705 |
| 1,972,285 | 9/1934 | Bennett | 72/704 |
| 2,134,501 | 10/1938 | Bennett | 72/705 |
| 2,142,850 | 1/1939 | Johnston | 72/705 |
| 2,830,789 | 4/1958 | MacMillan | 72/705 |
| 3,590,623 | 7/1971 | Nunnicutt | 72/705 |
| 3,623,353 | 11/1971 | Dinerman | 72/705 |

FOREIGN PATENT DOCUMENTS

| | | | |
|---|---|---|---|
| 1,295,511 | 11/1972 | United Kingdom | 72/705 |

*Primary Examiner*—C.W. Lanham
*Assistant Examiner*—Gene P. Crosby
*Attorney, Agent, or Firm*—Fishburn, Gold & Litman

[57] ABSTRACT

A vehicle axle straightening system for straightening a bent and twisted vehicle axle includes members engaging the axle to hold certain portions while forces are applied to the axle at portions spaced therefrom to bend and twist the axle to return same to its original orientation, the system particularly includes a pair of axle engaging assemblies each extending between and having opposite end portions thereof attached to respective anchors mounted in a floor and each assembly having a top member engageable with an upper surface of the vehicle axle thereby resisting upward movement of the respective engaged portion of the vehicle axle in response to an upwardly directed force by a force applying device extending between the floor and a selected portion of the vehicle axle and spaced from the axle engaging assemblies. The floor anchor for heavy truck axles has anchor sleeves or pots spaced along and secured to structural members which are in spaced parallel opposed relation and plates or webs connecting the opposed sleeves all set in a thick concrete floor. The vehicle axle straightening system includes an elongated bar positioned substantially normal to the vehicle axle and having a wrench portion at one end thereof engageable with the vehicle axle and adapted to twist same in response to a force applied to another end of the elongated member while the connections to the anchors hold down the axle. The vehicle axle straightening system includes a lever member having one end portion engageable with the upper surface of the vehicle axle and adapted to apply a downwardly directed force thereto in response to an upwardly directed force applied to another end portion of the lever member for moving same about a fulcrum in engagement with a lower surface of the vehicle axle.

16 Claims, 15 Drawing Figures

Fig. 6.
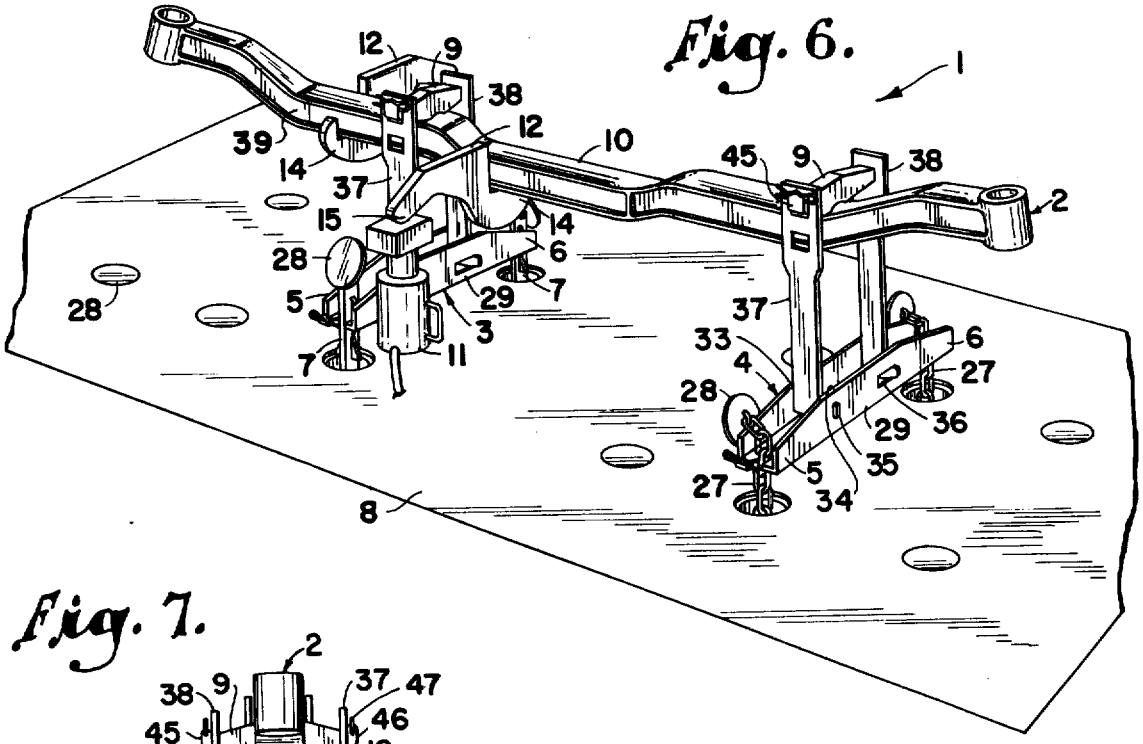
Fig. 7.
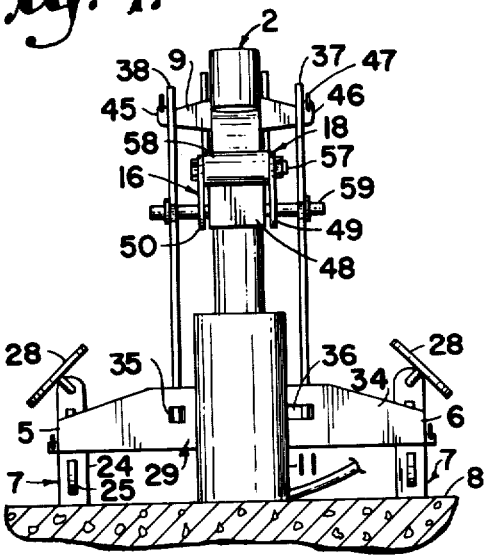
Fig. 8.
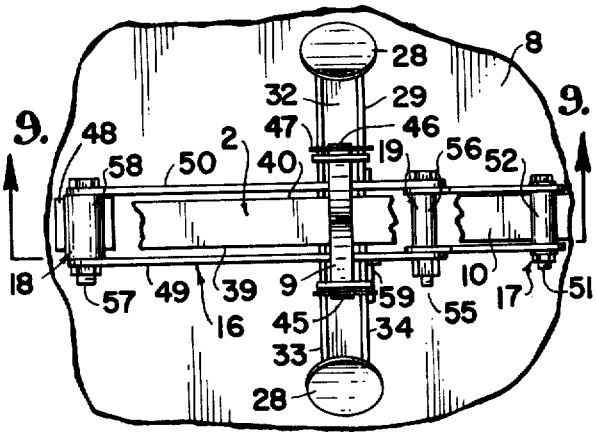
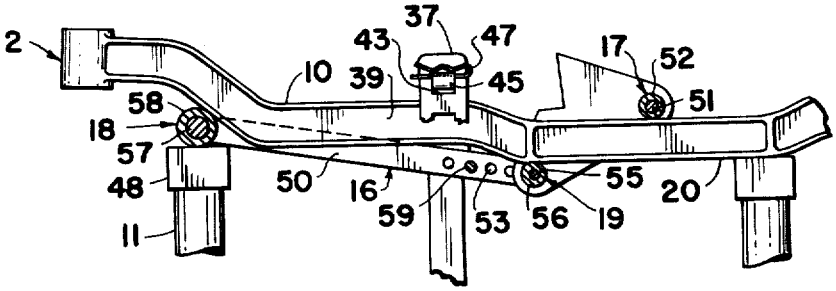
Fig. 9.

VEHICLE AXLE STRAIGHTENING SYSTEM

This application is a continuation-in-part of copending application Ser. No. 626,450, filed Oct. 28, 1975, now abandoned.

The present invention relates to apparatus for repairing damaged vehicle frames and axles and more particularly to a vehicle axle straightening system for straightening a bent and twisted vehicle axle.

The principal objects of the present invention are: to provide a vehicle axle straightening system for straightening a bent and twisted vehicle axle and particularly for straightening heavy truck axles; to provide a vehicle axle straightening system including a reinforced concrete floor with an upper surface thereof substantially flush with an upper surface of an adjacent floor; to provide such an axle straightening system having a plurality of center hold downs mounted in the floor and each adapted to resist a pull of up to and including substantially 50 tons and having a plurality of end hold downs mounted in the floor and each adapted to resist a pull of up to and including substantially 25 tons; to provide such an axle straightening system with the floor hold downs being longitudinally spaced and arranged in laterally spaced rows; to provide such an axle straightening system having a structure in which anchors of each row are fixed to elongate structural members and the opposed anchors of the rows are fixed to each other by spacing plates with the anchors' structural members and plates forming a rigid assembly in a reinforced concrete floor; to provide such an axle straightening system wherein the axle may remain on the vehicle during straightening and including means to check the wheels during straightening of the axle; to provide such a vehicle axle straightening system including means to twist a vehicle axle and to bend same upwardly or downwardly relative to an axle engaging assembly; and to provide such a vehicle axle straightening system which is economical to manufacture, easy to use, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the vehicle axle straightening system.

FIG. 6 is a perspective view of additional components of the system including a pair of wrench members adapted to apply a twisting force to the vehicle axle.

FIG. 7 is a side elevational view of a lever member of the system and adapted to apply a downwardly directed force to an upper surface of a vehicle axle.

FIG. 8 is a fragmentary top plan view of the lever member with portions of the vehicle axle broken away.

FIG. 9 is a longitudinal sectional view through the lever member and taken on line 9—9 of FIG. 8.

Figure 1:
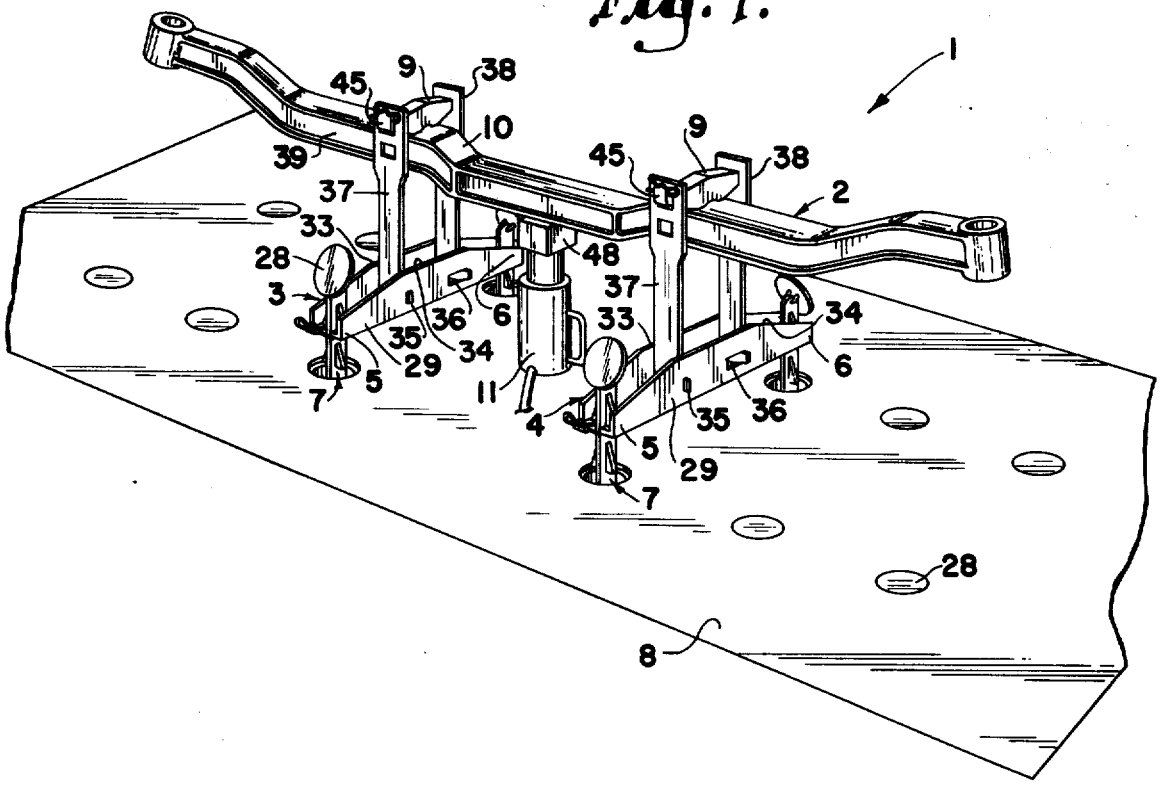
FIG. 1 is a perspective view of certain components of a vehicle axle straightening system embodying features of the present invention and shown in operative engagement with a vehicle axle to be straightened.
Figure 2:
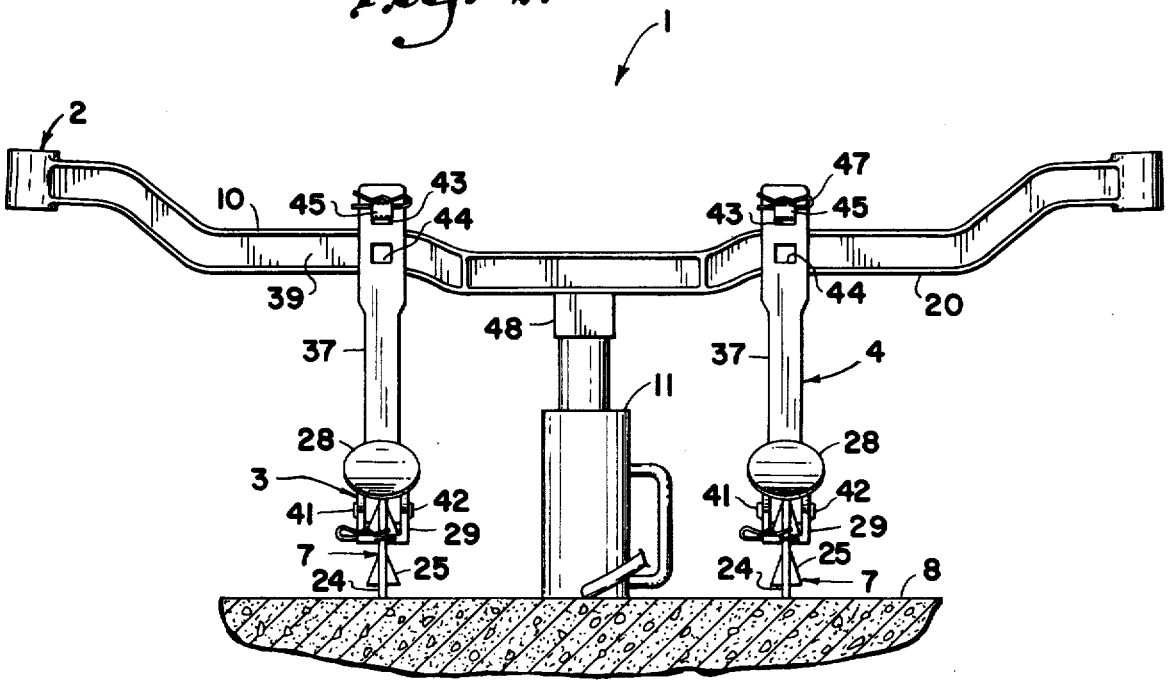
FIG. 2 is a front elevational view of certain components of the vehicle axle straightening system.
Figure 3:
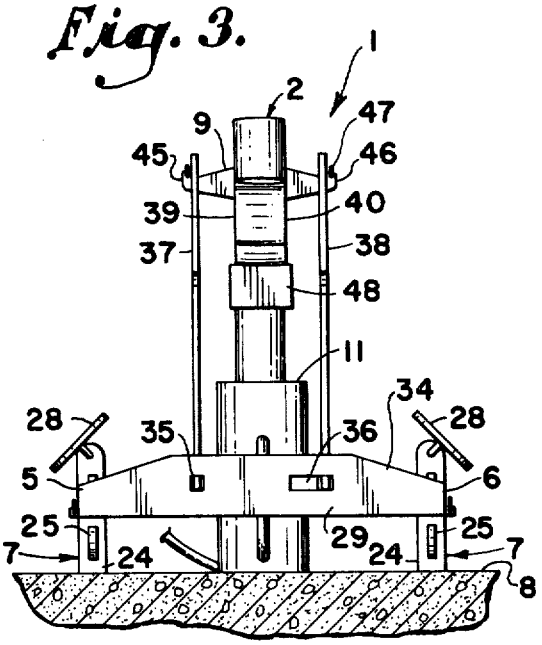
FIG. 3 is a side elevational view of certain components of the vehicle axle straightening system.
Figure 5:
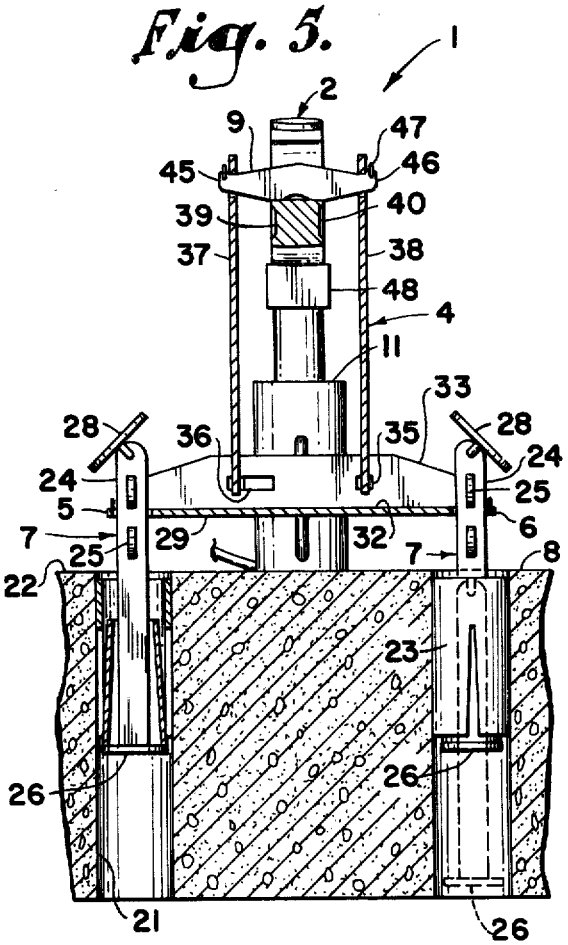
FIG. 5 is a cross-sectional view taken on line 5—5 of FIG. 4 and showing an axle engaging assembly attached to floor anchors.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiments of the present invention, the reference numeral 1 generally designates a vehicle axle straightening system for straightening a bent and twisted vehicle axle 2. The vehicle axle straightening system 1 includes a pair of axle engaging assemblies 3 and 4 each extending between and having opposite end portions 5 and 6 thereof attached to respective anchors 7 mounted in a floor 8 and each having a top member 9 engageable with an upper surface 10 of the vehicle axle 2 thereby resisting upward movement of the respective engaged portion of the vehicle axle 2 in response to an upwardly directed force by a force supplying device 11 extending between the floor 8 and a selected portion of the vehicle axle 2 and spaced from the axle engaging assemblies 3 and 4. The vehicle axle straightening system 1 includes at least one elongated bar 12 cooperating with the hold downs and positioned substantially normal to the vehicle axle 2 and having a wrench portion 14 at one end thereof engageable with the vehicle axle 2 and adapted to twist same in response to a force applied to an other end portion 15 of the elongated member 12. The vehicle axle straightening system 1 includes a lever member 16 also cooperating with the hold downs and force applying members, said lever member 16 having one end portion 17 engageable with the upper surface 10 of the vehicle axle 2 and adapted to apply a downwardly directed force thereto in response to an upwardly directly force applied to an other end portion 18 of the lever member 16 for moving the opposite end portions thereof about a fulcrum 19 in engagement with a lower surface 20 of the vehicle axle 2.

Figure 4:
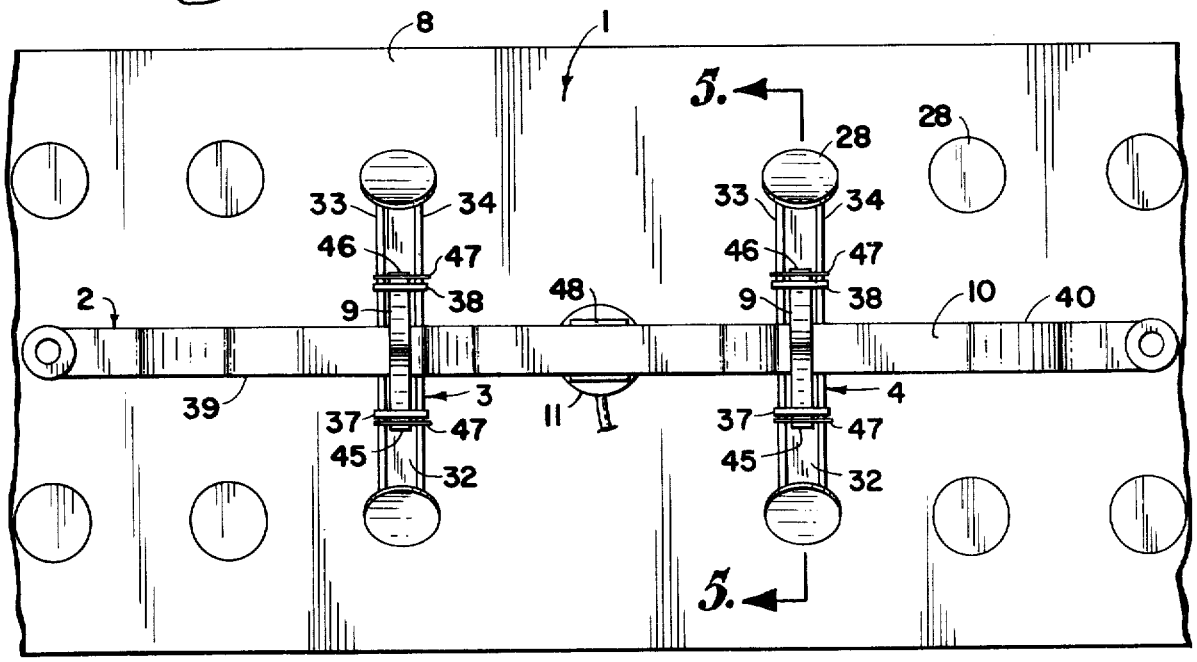
FIG. 4 is a top plan view of certain components of the vehicle axle straightening system.

The floor 8 is a reinforced concrete structure having a thickness sufficient to support heavy trucks. The floor 8 preferably has a width and length to permit an entire vehicle to be positioned thereon. The anchors 7 are longitudinally spaced in laterally spaced rows, as best seen in FIG. 4. The floor 8 has surfaces defining a plurality of receptacles 21 therein with each receptacle 21 extending downwardly from an upper surface 22 of the floor 8. Each receptacle has a respective one of the anchors 7 mounted therein.

Each of the anchors 7 has a liner member 23 mounted in the respective receptacle 21 and having an exterior surface thereof in frictional engagement with the respective receptacle defining surface. Each liner member 23 is illustrated as an open ended cylindrical member having a plurality of circumferentially spaced slots extending upwardly from a lower end thereof to a location intermediate the ends thereof. Each anchor has a tapered sleeve that is pulled up inside of each liner 23 in the portion having the slots expanding the liner into positive engagement with the surface of the receptacle 21 of the concrete floor 8. The lower end of the liner member 23 is positioned above a bottom of the floor 8. An elongated anchor bar 24 is positioned in certain of the liner members 23, for example, the center two anchors in each of the laterally spaced rows. Each anchor bar 24 has a plurality of ears 25 extending therefrom and arranged in vertically spaced pairs with the ears in each pair extending from opposite sides of the bar 24, for a purpose later described.

A plug member 26 is mounted on a lower end of each of the anchor bars 24 and is movable into engagement with an interior surface of the respective liner member 23 when the anchor bar 24 is raised for engagement of a respective pair of the ears 25 thereon with the respective axle engaging assembly.

The remaining liner members 23 each have an elongated flexible member 27 therein, such as a heavy duty chain. A plug member 26 is mounted on the lower end of the chain 27 and is movable into engagement with an interior surface of the respective liner member 23 when the flexible member 27 is raised for engagement with or attachment to a respective one of the axle engaging assemblies, as later described.

Each of the receptacles 21 has a removable closure member 28 mounted therein and adapted to be substantially flush with the upper surface 22 of the floor 8 when in position closing the respective receptacle 21.

The axle engaging assemblies 3 and 4 provide means attached to certain of the anchors 7 and in engagement with certain portions of the vehicle axle 2 to be straightened for retaining same in a selected position. The axle retaining means or assemblies 3 and 4 are adapted to resist upwardly movement of the vehicle axle 2.

In the illustrated embodiment, each of the axle engaging assemblies 3 and 4 includes an elongated beam member 29 having opposite end portions 5 and 6 thereof each adapted to be attached to respective one of the anchors 7. The beam members 29 are illustrated as generally channel shaped and each having a bottom or web portion 32 and opposed flange portions 33 and 34 extending upwardly from the opposite side edge portions of the web portion 32. The opposite end portions 5 and 6 each are bifurcated, as by having a slot formed therein, whereby the opposite end portions 5 and 6 are each adapted to receive therein either the anchor bar 24 of a respective one of the center anchors 7 or the chain 27 of a respective one of the end anchors 7. Each of the flange portions 33 and 34 of each of the beam members 29 has a pair of longitudinally spaced apertures 35 and 36 therein with the apertures in one flange portion being laterally aligned with the apertures in the other flange portions.

Each of the axle engaging assemblies 3 and 4 includes a pair of longitudinally spaced standards 37 and 38 each having a lower end thereof mounted on the respective beam member 29 and an upper end thereof positioned above the vehicle axle 2. The standards 37 and 38 are positioned adjacent a leading side 39 and a trailing side 40 respectively of the vehicle axle 2. In the illustrated structure, the standards 37 and 38 each have ribs 41 and 42 extending outwardly therefrom and positioned adjacent a lower end thereof. The ribs 41 and 42 are adapted to be received in a respective pair of laterally aligned apertures in the flange portions 33 and 34 of the respective beam member 29. The upper end portion of each of the standards 37 and 38 has a pair of vertically spaced upper and lower apertures 43 and 44 therein. The apertures 43 and 44 in one of the standards are laterally aligned with the apertures in the other standard when the standards 37 and 38 are mounted on the respective beam member 29.

Each of the axle engaging assemblies 3 and 4 includes a top member 9 in engagement with the upper surface 10 of the vehicle axle 2. The top member 9 has opposite end portions 45 and 46 thereof each in retained engagement with a respective one of the standards 37 and 38. The illustrated top member 9 extends through a respective pair of the upper and lower apertures and is secured in position by a suitable fastening member, such as a cotter pin 47, to thereby substantially prevent relative movement between the top member 9 and the standards 37 and 38.

The force applying device 11 provides means extending between the floor 8 and a selected portion of the vehicle axle 2 for applying force to the selected portion of the vehicle axle 2. The force applying means is spaced from the axle engaging assemblies 3 and 4 and is adapted to apply an upwardly directed force to the lower surface 20 of the selected portion of the vehicle axle 2. The force applying device 11 may be any suitable extensible member such as a hydraulic jack having an upper end portion adapted to be selectively raised and lowered. A suitable block 48 is preferably positioned between the upper end of the extensible member and the lower surface 20 of the vehicle axle 2. The block 48 is preferably shaped to conform to and receive the axle 2 therein.

FIG. 6 illustrates twisting means engaging the vehicle axle 2 and the force applying device 11 for twisting the vehicle axle 2 relative to the axle engaging assemblies 3 and 4 upon applying of a force to the twisting means at a point spaced from the vehicle axle 2. The twisting means includes at least one elongated bar 12 positioned substantially normal to the vehicle axle 2 and having a first end or wrench portion 14 formed in a generally U-shape to simultaneously engage the leading side 39 and the trailing side 40 of the vehicle axle 2. As best seen in FIG. 6, a pair of the elongated bars or wrench members 12 extend outwardly from opposite side of the vehicle axle 2 with respective force applying devices 11 being in engagement with a lower side of the other end portion 15 of the respective elongated bar 12.

FIGS. 7 to 9 inclusive illustrative the lever member 16 for applying a downwardly directed force to the upper surface 10 of the vehicle axle 2 in response to an upwardly directed force applied to the other end portion 18 of the lever member 16. The lever member 16 is adapted to be positioned substantially parallel with and below the vehicle axle 2. The illustrated lever member 16 is bifurcated and formed of laterally spaced planar members 49 and 50 positioned adjacent the leading side 39 and the trailing side 40 respectively of the axle 2. The lever member 16 extends between the standards 37 and 38 of at least one of the axle engaging assemblies.

Means are mounted on one of the opposite end portions, for example the one end portion 17 of the lever member 16, for engaging the upper surface 10 of the vehicle axle 2 and extending between the leading side 39 and the trailing side 40 of the vehicle axle 2. The illustrated one end portion 17 of the lever member 16 includes a bar or shaft 51 with opposite end portions thereof extending through suitable apertures in the planar members 49 and 50. The shaft 51 is adapted to effect clamping engagement between the planar members 49 and 50 and opposite ends of a tubular spacer 52. The spacer 52 is sleeved on the shaft 51 and clamping engagement between same and the planar members 49 and 50 is effected by suitable nuts on opposite ends of the shaft 51.

Means are mounted intermediate the ends of the lever member 16 for engaging the lower surface 20 of the vehicle axle 2 and extends between the leading side 39 and the trailing side 40 of the vehicle axle 2 thereby defining the fulcrum 19. In the illustrated embodiment, the planar members 49 and 50 have a plurality of longitudinally spaced apertures 53 respectively therein which are laterally aligned. A fulcrum bar or shaft 55 has opposite end portions thereof extending through a respective pair of the aligned apertures 53 and adapted to effect clamping engagement between the planar members 49 and 50 and opposite ends of a tubular spacer 56 sleeved on the shaft 55, as by suitable nuts on opposite ends of the shaft 55. The fulcrum defining shaft 55 is preferably positioned in the pair of aligned apertures 53 closest to the one end portion 17 and fartherest from the other end 18 of the lever member 16.

Means on the other end portion 18 of the lever member 16 is engageable by the force applying device 11 whereby the lever member 16 is moved about the fulcrum 19 to apply a downwardly directed force to the upper surface 10 of the vehicle axle 2 at the one end portion 17 of the lever member 16 in response to an upwardly directed force at the other end portion 18 of the lever member 16. In the illustrated embodiment, a bar or shaft 57 has opposite end portions thereof extending through suitable apertures in the planar members 49 and 50 and is positioned at the other end portion 18 thereof. The shaft 57 is adapted to effect clamping engagement between the planar members 49 and 50 and opposite ends of tubular spacer 58 sleeved on the shaft 57, as by suitable nuts on opposite ends of the shaft 57. The shafts 51, 55 and 57 thereby cooperate to thereby define a substantially rigid lever member 16. A block 48 is preferably positioned between the upper end of the force applying device 11 and the tubular spacer 58.

The lever member 16 preferably includes means mounted thereon and positioned adjacent the fulcrum 19 and engageable with the pair of standards 37 and 38 of a respective one of the axle engaging assemblies for limiting movement of the lever member 16 along the vehicle axle 2 during application of force to the other end portion 18 of the lever member 16.

In the illustrated embodiment, an elongated rod 59 is positioned in a respective pair of apertures 53 in the intermediate portion of the planar members 49 and 50. The apertures 53 are positioned so that the rod 59, fulcrum bar 55, and end bar 51 are on one side of the standards 37 and 38 and the other end bar 57 is on the other side of the standards 37 and 38.

Figure 10:
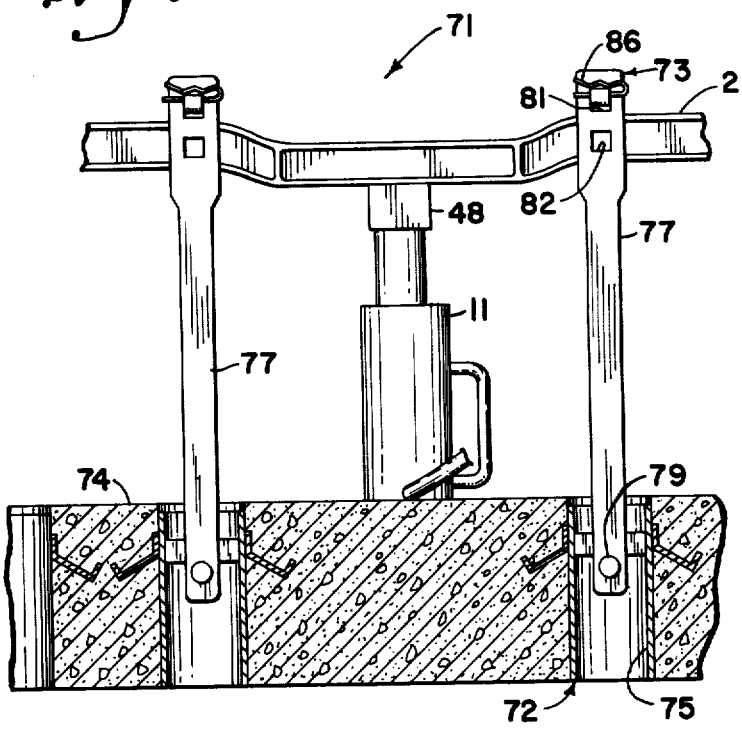
FIG. 10 is a front elevational view of modified components of the vehicle axle straightening system.
Figure 12:
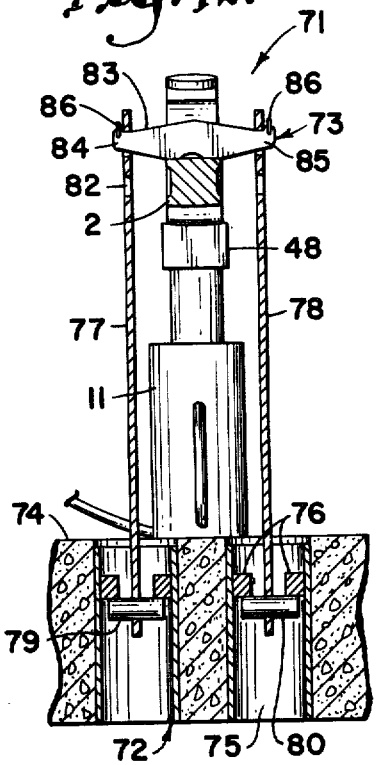
FIG. 12 is a cross-sectional view taken on line 12—12 of FIG. 11 and showing a modified axle engaging assembly.
Figure 11:
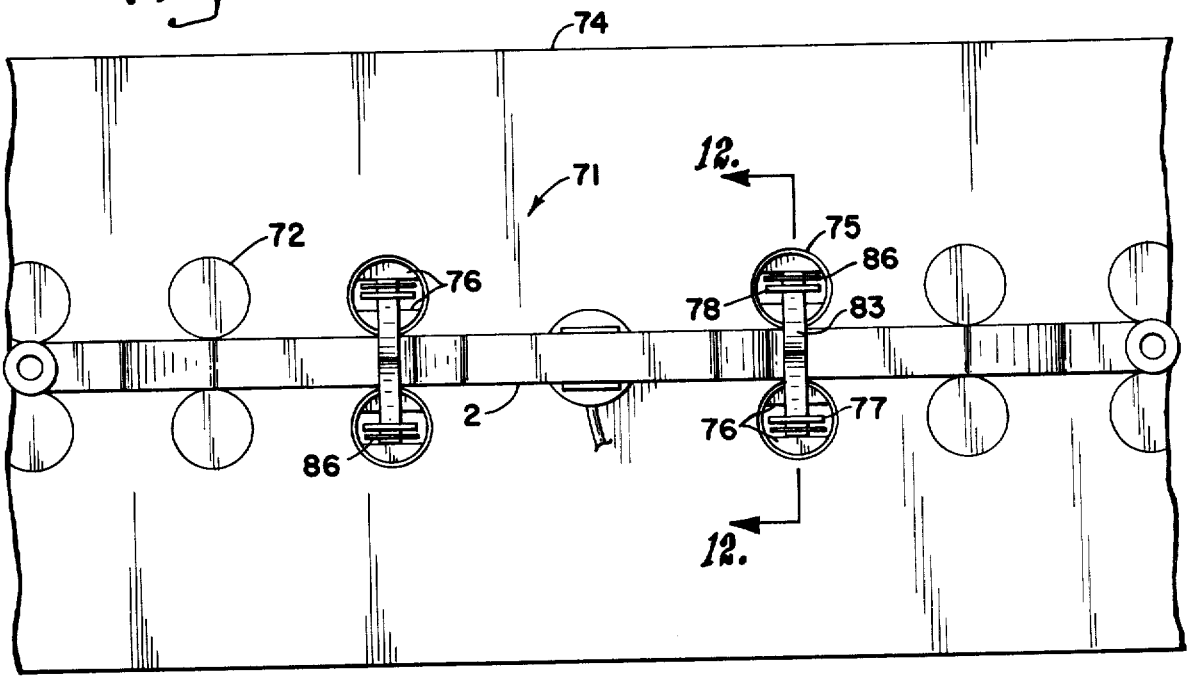
FIG. 11 is a top plan view of the modified components of the vehicle axle straightening system.

FIGS. 10 to 12 inclusive illustrate a modified vehicle axle straightening system 71 including modified anchor means 72 and modified axle retaining means 73. In the illustrated embodiment, a floor structure 74 has the modified anchor means 72 therein and arranged in laterally spaced rows each substantially parallel to the vehicle axle 2.

The anchor means 72 includes a plurality of tubular members 75 mounted in the floor structure 74 and each having an open upper end. When the floor structure 74 is Portland Cement concrete, the tubular members 75 each may have bars, rods, straps, or other suitable anchors extending therefrom to suitably anchor same in the floor structure 74. Each of the tubular members 75 has an abutment member 76 mounted on an interior surface thereof and having an elongated slot therein. Each of the abutment members 76 is illustrated as a pair of laterally aligned portions positioned with edges thereof in facing relation thereby defining the elongated slot.

The modified axle retaining means 73 is engageable with the anchor means 72 and a certain portion of the vehicle axle 2 for retaining the axle to be straightened in a selected position. The axle retaining means 73 is particularly adapted to resist upward movement of the vehicle axle 2. In the illustrated embodiment, each axle retaining means 73 includes a pair of longitudinally spaced standards 77 and 78 having lower end portions each extending through the slot in a respective one of the abutment members 76. Stop members 79 and 80 are mounted in or on the lower end portions of the standards 77 and 78 respectively and are positioned below and engageable with a lower surface of the respective abutment members 76.

The distance between facing edges of each abutment member 76 is greater than the width of the lower end portion of the respective standards 77 and 78 and less than the length of the respective stop means 79 and 80 whereby the standards 77 and 78 with the stop members 79 and 80 respectively mounted thereon may be lowered into the respective tubular member 75 with the stop member thereon moving through the elongated slot in the abutment member 76 and then turned 90° to move the stop member substantially normal or perpendicular to the length of the slot in the abutment member 76. The respective stop member is then moved into engagement with the lower surface of the respective abutment member 76.

The standards 77 and 78 have at least two apertures 81 and 82 in the upper end portions thereof. A top member 83 is adapted to have a lower surface thereof in engagement with an upper surface of the axle 2. The top member 83 has opposite end portions 84 and 85 thereof extending through a respective one of the apertures 81 and 82 in the upper end portions of the standards 77 and 78 respectively and suitably retained in position by a fastening member, such as a cotter pin 86, to thereby substantially prevent relative movement between the top member 83 and the standards 77 and 78.

Figure 13:
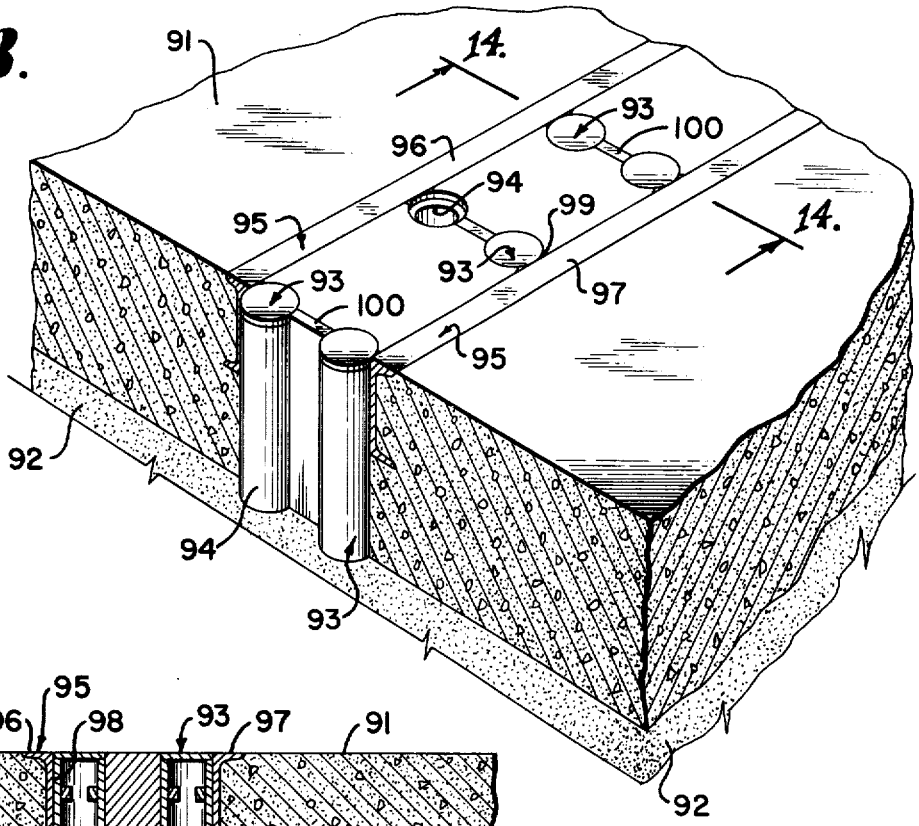
FIG. 13 is a perspective view of further modified form of straightening system with portions broken away to show the anchor structure.
Figure 14:
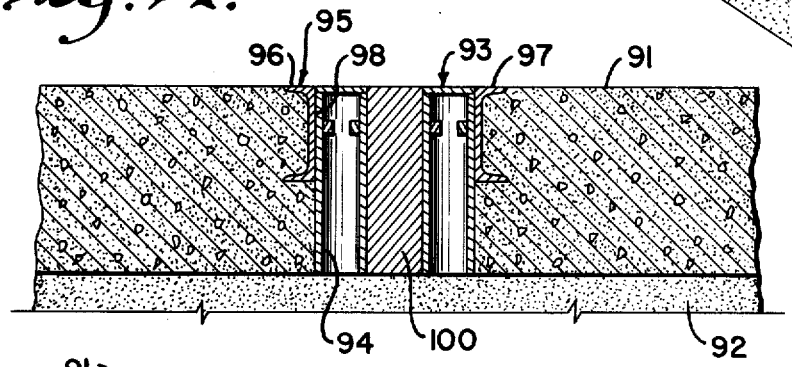
FIG. 14 is transverse sectional view of the anchor structure taken on the line 14—14, FIG. 13.
Figure 15:
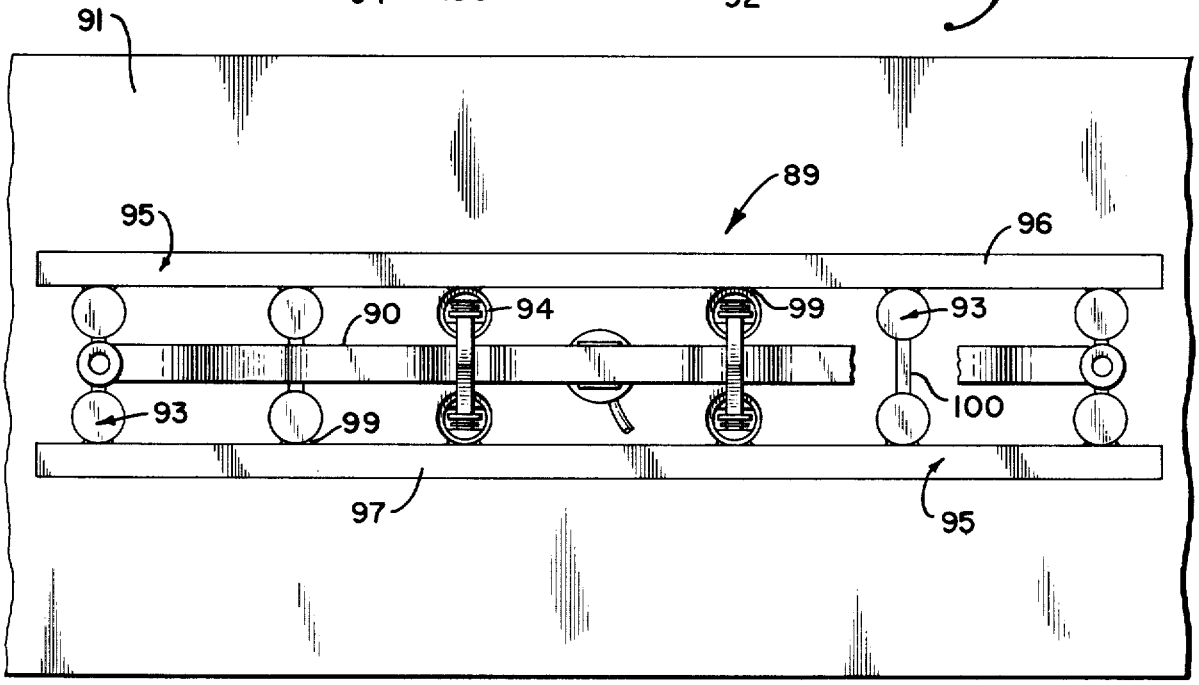
FIG. 15 is a plan view of said further modified form of the anchor structure with an axle positioned thereon.

FIGS. 13 to 15 inclusive illustrate a further modified vehicel axle straightening system 89 which is particularly adapted for handling axles 90 of very heavy trucks. In such straightening it is necessary to apply very substantial forces which must be resisted by forces in the floor system requiring great strength in the floor and anchor structure. In the form shown, the floor 91 is reinforced concrete of substantial thickness, preferably having a suitable sand or porous substructure 92.

The system shown includes a plurality of anchor means 93 illustrated as having substantially the same structure as the anchor means 72 shown in FIGS. 10 to 12 inclusive with the exception that the liners 94 are fixed as by welding to elongate structural members 95. In the illustrated structure there are spaced elongate structural members 96 and 97, there being one such member for each row of the anchors. The structural members 96 and 97 in the illustrated structure are in the form of channels each having a web 98 in facing relation and the liners 94 of the respective rows are fixed to the webs as by welding, as at 99, preferably for the length of the engagement therebetween. This provides a structure wherein the elongate structural members 96 and 97 are in laterally spaced relation with the liners 94 of the anchors fixed thereto so that the liners are in opposed relation as illustrated in FIGS. 13 and 15. Rigid members 100 extend between the liners 94 and are secured thereto to form spacing members and also form rigid connectors whereby the elongated structural members 96 and 97, liners 94 and rigid members 100 all are a unitary rigid structure arranged to be imbedded in the concrete floor 91.

It is preferred that the rigid members 100 be in the form of plates that extend for the length of the liners and form rigid connectors therebetween. It is preferred that the elongate structural members 96 and 97, anchor liners 94 and plate members 100 all be arranged and secured together as by welding into a rigid unitary structure and that said unitary structure then be positioned in the proper location in a floor to be poured of reinforced concrete so that when the floor is completed the anchors and the supports therefor provide a very strong structure capable of withstanding the great loads that are applied in straightening large truck axles.

The structure of FIGS. 13 to 15 inclusive is used to straighten heavy axles and when an axle is in position as illustrated in FIG. 15 the structure operates substantially as described, relative to the form of the invention illustrated in FIGS. 10 to 12 inclusive.

It is to be understood that while I have illustrated and described one form of my invention, it is not to be limited to the specific form or arrangement of parts herein described and shown.

What I claim and desire to secure by Letters Patent is:

1. A vehicle axle straightening system comprising:
   a. a plurality of anchors attached to a floor and positioned in laterally spaced rows substantially parallel to an axle to be straightened;
   b. means attached to certain of said anchors and in engagement with a certain portion of a vehicle axle to be straightened for retaining same in a selected position, said axle retaining means being adapted to resist upward movement of the vehicle axle;
   c. means extending between the floor and a selected portion of the vehicle axle for applying a force to said selected portion, said force applying means being spaced from said axle retaining means;
   d. said anchors each having a liner member extending downwardly from adjacent an upper surface of said floor, said anchor liner members being fixed in said floor;
   e. certain of said anchors having an elongate bar with a plurality of ears extending therefrom and engageable with said axle retaining means;
   f. certain of said anchors having cooperative means on said elongate bar and said liner member for engagement upon raising of said bar for engagement of certain of said ears thereof with said respective axle retaining means.

2. A vehicle axle straightening system as set forth in claim 1 wherein:
   a. said floor having surfaces defining a plurality of receptacles therein with each receptacle extending downwardly from an upper surface of said floor;
   b. said receptacles in the floor each having a respective one of said anchors mounted therein;
   c. said anchors each having a liner member mounted in the respective receptacle and in frictional engagement with the respective receptacle defining surface;
   d. said cooperative member of said certain anchors being a plug member movable into engagement with said liner member upon raising of said bar for engagement of certain of said ears thereof with said respective axle retaining means.

3. A vehicle axle straightening system as set forth in claim 1 wherein:
   a. said axle retaining means includes a pair of axle engaging assemblies;
   b. said axle engaging assemblies including an elongated beam member positioned below the vehicle axle and having opposite end portions thereof each attached to a respective one of said anchors;
   c. said axle engaging assemblies including means mounted on said beam member thereof and in engagement with an upper surface of the vehicle axle to thereby resist upward movement of the vehicle axle;
   d. said floor having surfaces defining a plurality of receptacles therein and each extending downwardly from an upper surface thereof and each having a respective one of said anchors mounted therein;
   e. said anchors each having a liner member mounted in the respective receptacle and in expanded clamping engagement with the respective receptacle defining surface;
   f. said elongate bar of certain of said anchors each having a plurality of ears extending therefrom and engageable with a respective one of the opposite end portions of said beam member of a respective one of said axle engaging assemblies; and
   g. said bar of each of said certain anchors having a plug member mounted thereon and movable into engagement with said liner member upon raising of said bar for engagement of certain of said ears thereof with the respective beam member opposite end portion.

4. A vehicle axle straightening system as set forth in claim 1 and including:
   a. an elongate structural member for each row of anchors and having the liner members of the respective row fixed thereto;
   b. said elongate members being in laterally spaced parallel relation;
   c. rigid means extending between opposed liners of the rows of anchors and fixed thereto;
   d. said floor being of reinforced concrete and having said elongate structural members, liners and rigid means embedded. therein.

5. A vehicle axle straightening system as set forth in claim 4 wherein:

a. said rigid means are plate members extending the height of the liners;

b. said structural members are channels with webs thereof forcing inwardly and the liners fixed to said webs.

6. A vehicle axle straightening system comprising:

a. a plurality of anchors attached to a floor and positioned in laterally spaced rows substantially parallel to an axle to be straightened;

b. means attached to certain of said anchors and in engagement with a certain portion of a vehicle axle to be straightened for retaining same in a selected position, said axle retaining means being adapted to resist upward movement of the vehicle axle;

c. means extending between the floor and a selected portion of the vehicle axle for applying a force to the selected portion of the vehicle axle, said force applying means being spaced from said axle retaining means;

d. an elongated lever member adapted to be positioned substantially parallel with the vehicle axle, said lever member having opposite end portions;

e. means on one of the opposite end portions of said lever member for engaging an upper surface of the vehicle axle;

f. means intermediate the ends of said lever member for engaging a lower surface of the vehicle axle and defining a fulcrum; and g. means on the other of the opposite end portions of said lever member engageable by said force applying means whereby said lever member is moved about the fulcrum to apply a downwardly directed force to the upper surface of the vehicle axle at the one end portion of said lever member in response to an upwardly directed force at the other end portion of said lever member.

7. A vehicle axle straightening system as set forth in claim 6 including means mounted on said lever member and positioned adjacent the fulcrum and engageable with said axle retaining means for limiting movement of said lever member along the vehicle axle during application of force to the other end portion of said lever member.

8. A vehicle axle straightening system as set forth in claim 7 wherein said lever member is bifurcated and has respective portions thereof adjacent a leading side and a trailing side of the vehicle axle.

9. A vehicle axle straightening system comprising:

a. a plurality of longitudinally spaced anchors attached to a floor and positioned in laterally spaced rows;

b. a pair of axle engaging assemblies each extending between the rows of anchors and each attached to certain of said anchors and engageable with an upper surface of a vehicle axle to be straightened, said axle engaging assemblies being longitudinally spaced along the vehicle axle and each adapted to resist upward movement of the respective engaged portion of the vehicle axle; including:

1. an elongated beam member positioned below the vehicle axle and having opposite end portions thereof each attached to a respective one of said anchors;

2. a pair of longitudinally spaced standards each having a lower end thereof mounted on said beam member and an upper end thereof positioned above the vehicle axle, said standards being positioned adjacent a leading side and a trailing side respectively of the vehicle axle;

3. a top member in engagement with an upper surface of the vehicle axle and having opposite end portions thereof each in retained engagement with a respective one of said standards;

c. at least one force applying device extending between the floor and a lower surface of a selected portion of the vehicle axle and adapted to apply an upwardly directed force to the selected portion of the vehicle axle;

d. a floor having surfaces defining a plurality of receptacles therein and each receptacle extending downwardly from an upper surface of said floor;

e. said receptacles in the floor each having a respective one of said anchors mounted therein;

f. said anchors each having a liner member mounted in the respective receptacle and in expanded clamping engagement with the respective receptacle defining surface;

g. certain of said anchors each having an elongated bar with a plurality of ears extending therefrom and engageable with a respective end portion of said beam member of a respective axle engaging assembly; and h. said bar of each of said certain anchors having a plug member mounted thereon and movable into engagement with said liner member upon raising of said bar for engagement of certain of said ears thereof with said respective beam member end portion.

10. A vehicle axle straightening system as set forth in claim 9 including twisting means engaging the vehicle axle and said force applying device for twisting the vehicle axle relative to said axle engaging assemblies upon applying of a force to said twisting means at a point spaced from the vehicle axle, said twisting means comprising at least one elongated member positioned substantially normal to the vehicle axle and having a first end portion engageable by said force applying device and a second end portion formed in a generally U-shape to simultaneously engage the leading side and the trailing side of the vehicle axle.

11. A vehicle axle straightening system as set forth in claim 9 including:

a. an elongated lever member adapted to be positioned substantially parallel with and below the vehicle axle, said lever member having opposite end portions;

b. means on one of the opposite end portions of said lever member for engaging an upper surface of the vehicle axle and extending between the leading side and the trailing side of the vehicle axle;

c. means intermediate the ends of said lever member for engaging a lower surface of the vehicle axle and extending between the leading side and the trailing side of the vehicle axle thereby defining a fulcrum; and d. means on the other of the opposite end portions of said lever member engageable by said force applying device whereby said lever member is moved about the fulcrum to apply a downwardly directed force to the upper surface of the vehicle axle at the one end portion of said lever member in response to an upwardly directed force at the other end portion of said lever member.

12. A vehicle axle straightening system as set forth in claim 11 including means mounted on said lever member and positioned adjacent the fulcrum and engageable with said pair of standards of a respective one of said axle engaging assemblies for limiting movement of said lever member along the vehicle axle during applicagion of force to the other end portion of said lever member.

13. A vehicle axle straightening system as set forth in claim 12 wherein:

a. said lever member is bifurcated and has respective portions thereof positioned adjacent the leading side and the trailing side of the vehicle axle; and b. said lever member is positioned between said pair of standards of a respective one of said axle engaging assemblies.

14. A vehicle axle straightening system comprising:

a. a floor structure having anchor means therein, said anchor means being arranged in laterally spaced rows each substantially parallel to an axle to be straightened;

b. means engageable with said anchor means and with a certain portion of a vehicle axle to be straightened for retaining same in a selected position, said axle retaining means being adapted to resist upward movement of the vehicle axle;

c. means extending between said floor structure and a selected portion of the vehicle axle for applying a force to the selected portion of the vehicle axle, said force applying means being spaced from said axle retaining means;

d. said anchor means including:

1. a plurality of tubular members mounted in said floor structure and each having an open upper end and an interior surface; and 2. a plurality of abutment members each mounted on the interior surface of a respective one of said tubular members and each having an elongated slot therein; and e. axle retaining means including:

1. a pair of longitudinally spaced standards each extending through the slot in a respective one of said abutment members and having a lower end portion and an upper end portion, said lower end portion of each of said standards being below said respective abutment member;

2. a pair of stop members each mounted on the lower end portion of a respective one of said standards and engageable with said abutment member in a respective one of said tubular members; and 3. a top member in engagement with an upper surface of the vehicle axle and having opposite ends thereof each in retained engagement with the upper end portion of a respective one of said standards.

15. A vehicle axle straightening system comprising:

a. a plurality of anchors attached to a floor and positioned in laterally spaced rows substantially parallel to an axle to be straightened;

b. means attached to certain of said anchors and in engagement with a certain portion of a vehicle axle to be straightened for retaining same in a selected position, said axle retaining means including:

1. a pair of longitudinally spaced elongated beam members positioned below the vehicle axle and arranged transversely thereof and having opposite end portions thereof each attached to a respective one of said anchors;

2. a pair of longitudinally spaced standards each having a lower end thereof mounted on each said beam member and an upper end thereof positioned above the vehicle axle with said lower ends of the standards spaced between the opposite end portions;

3. a top member in engagement with an upper surface of the vehicle axle and having opposite ends thereof each in retained engagement with a respective one of said standards; and c. means extending between the floor and a selected portion of the vehicle axle for applying a force to the selected portion of the vehicle axle, said force applying means being spaced from said longitudinally spaced beam members.

16. A vehicle axle straightening system as set forth in claim 15 including a twisting means engaging the vehicle axle and force applying means for twisting the vehicle axle relative to said axle retaining means with each said engaging and force applying means located on opposing sides of said axle retaining means in opposing coordinating relation so as to twist said axle about a midpoint proximately located to said axle retaining means.

* * * * *